United States Patent [19]

Fecker

[11] Patent Number: 4,662,575

[45] Date of Patent: May 5, 1987

[54] YARN SUPPLY APPARATUS FOR TEXTILE MACHINES

[75] Inventor: Josef Fecker, Bisingen-Steinhofen, Fed. Rep. of Germany

[73] Assignee: Memminger GmbH, Freudenstadt, Fed. Rep. of Germany

[21] Appl. No.: 822,406

[22] PCT Filed: May 15, 1985

[86] PCT No.: PCT/DE85/00165

§ 371 Date: Dec. 16, 1985

§ 102(e) Date: Dec. 16, 1985

[87] PCT Pub. No.: WO85/05348

PCT Pub. Date: Dec. 5, 1985

[30] Foreign Application Priority Data

May 15, 1984 [DE] Fed. Rep. of Germany ..... 3417936

[51] Int. Cl.[4] ..... B65H 51/20

[52] U.S. Cl. ..... 242/47.01

[58] Field of Search ..... 242/47.01, 47.02, 47.03, 242/47.04, 47.05, 47.06, 47.07, 47.08, 47.09, 47.1, 47.11, 47.12, 47.13, 47; 66/132 R, 132 T, 146, 125 R; 139/452

[56] References Cited

U.S. PATENT DOCUMENTS

| | | | |
|---|---|---|---|
| 2,328,541 | 9/1943 | Bachlotte | 242/157 R |
| 4,114,823 | 9/1978 | Fecker et al. | 242/47.01 |
| 4,138,866 | 2/1979 | Fecker et al. | 242/47.01 X |
| 4,271,686 | 6/1981 | Memminger et al. | 242/47.01 X |
| 4,271,687 | 6/1981 | Memminger et al. | 242/47.01 X |
| 4,328,929 | 5/1982 | Memminger et al. | 242/47.01 |
| 4,361,292 | 11/1982 | Fecker et al. | 242/47.01 |
| 4,489,899 | 12/1984 | Calamani et al. | 242/47.01 |
| 4,574,597 | 3/1986 | Buck et al. | 242/47.01 X |

FOREIGN PATENT DOCUMENTS

| | | | |
|---|---|---|---|
| 2614702 | 1/1977 | Fed. Rep. of Germany . | |
| 2608590 | 9/1977 | Fed. Rep. of Germany . | |
| 2925777 | 1/1981 | Fed. Rep. of Germany | 242/47.01 |
| 8318792 | 12/1983 | Fed. Rep. of Germany . | |

*Primary Examiner*—Stanley N. Gilreath

*Attorney, Agent, or Firm*—Frishauf, Holtz, Goodman & Woodward

[57] ABSTRACT

A yarn supply apparatus for textile machines has a yarn drum (5) carrying a storage winding (10), to which drum the yarn (8) can be supplied at a tangent via a supply guide element, and from which drum the yarn can be drawn off, extending toward the outside, at a run-off speed corresponding to the yarn supply speed, via a run-off guide element (11) located laterally beside the yarn drum (5). In order to assure constantly satisfactory supply conditions even when a yarn drum (5) that effects the advancement of the storage winding solely via the particular shaping of its circumferential surface is used, the supply guide element is in the form of a bowed element (20) having an elongated yarn opening (22), this opening being located with its lengthwise extension transverse with respect to the yarn travel direction and having its lower edge, that is, the edge nearer the yarn drum, located below the upper rim of the yarn drum (5).

18 Claims, 12 Drawing Figures

Figure 1:
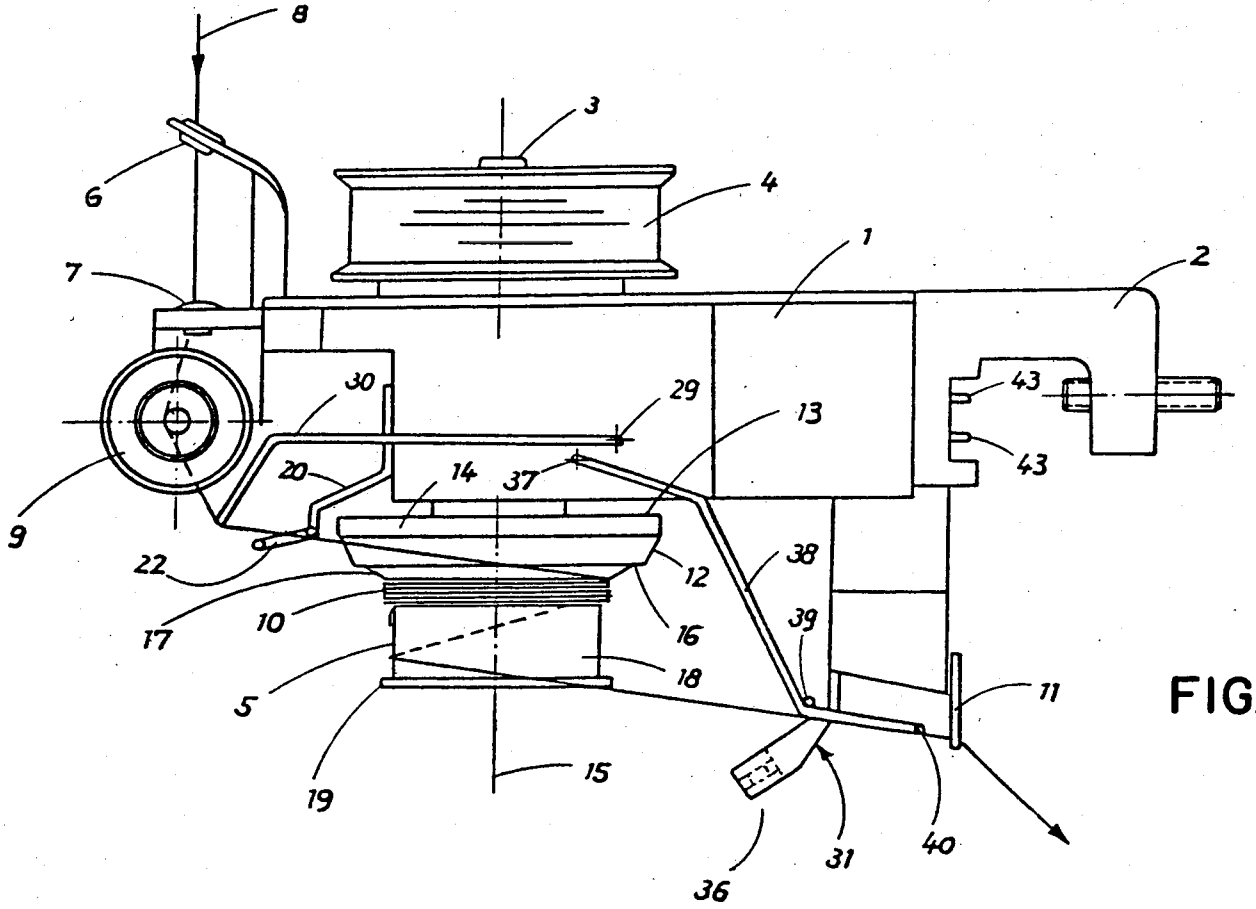

FIG. 6
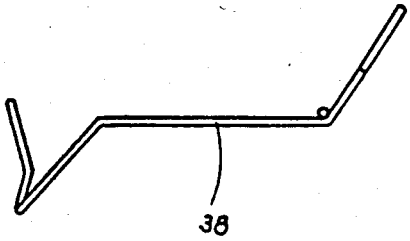
FIG. 7
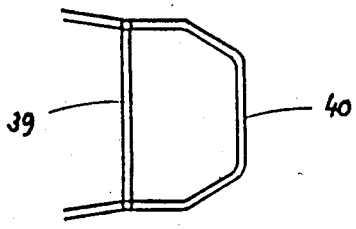
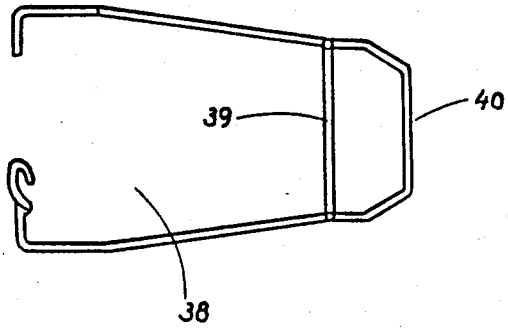
FIG. 5
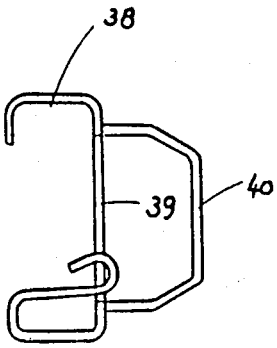
FIG. 8

FIG. 10
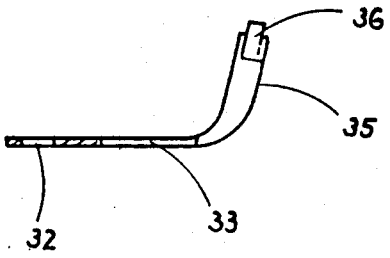
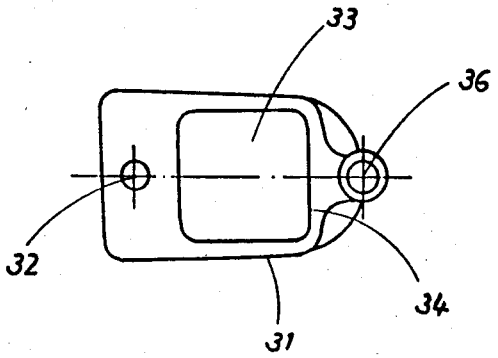
FIG. 9
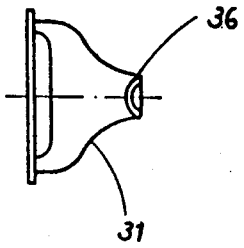
FIG. 11
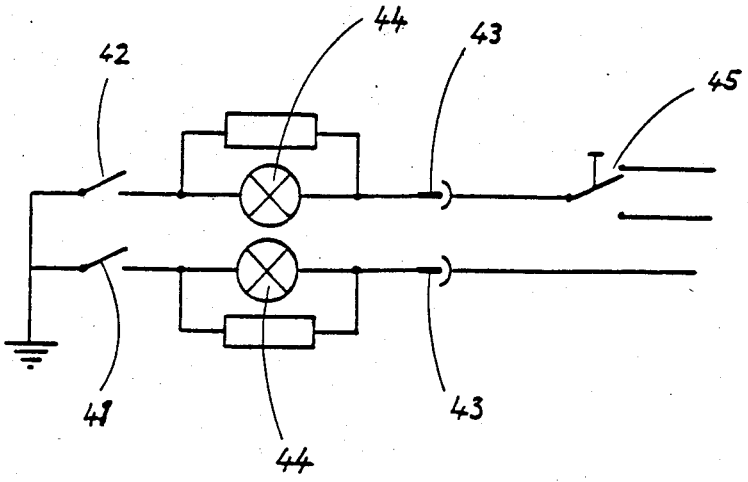
FIG. 12

YARN SUPPLY APPARATUS FOR TEXTILE MACHINES

The invention relates to a yarn supply apparatus for textile machines, having a yarn drum which carries a storage winding.

BACKGROUND

Yarn supplied to a yarn supply drum at a tangent via a supply guide element and drawn off from the drum, oriented outward, at a yarn take-off speed that corresponds to the yarn supply speed, via a run-off guide element disposed laterally beside the yarn drum. The run-off guide element is stationary and is disposed spaced apart from and below the lower rim of the yarn drum. Associated with the yarn drum are a supply yarn monitor, which, with a supply yarn sensor feels the supplied yarn prior to the supply guide element. A run-off yarn monitor, which, with a run-off sensor, feels the yarn as it is taken off in the vicinity of the run-off guide element.

A yarn supply apparatus of this kind is known, e.g., from German Patent DE-PS No. 26 08 590. The supply guide element here is formed by a yarn eye, which is stationary on the holder carrying the yarn drum and is located after the yarn brake in the path of yarn travel. The supply yarn sensor senses the supplied yarn on the yarn travel path between the yarn brake and this yarn eye. The yarn eye must be located a specific minimum distance from the circumference of the yarn drum, in order to prevent the yarn from being deflected to the side too abruptly on its way from the yarn eye to the circumference of the yarn drum. Because of this spacing of the yarn eye from the yarn drum, the yarn can change its direction of travel to the yarn drum if the tension on the supplied yarn changes, and this can have an undesirable influence on the buildup of the storage winding on the yarn drum.

In this known yarn supply apparatus, the storage winding formed on the yarn drum is compelled to advance axially on the yarn drum in a continuous manner by a feed device, in the form of a feed wheel driven by the yarn drum; in the event that yarn is not being drawn off, this prevents windings of the storage winding from shifting upward past the rim of the yarn drum.

In yarn supply apparatuses operating without this kind of compulsory feed device for the storage winding, and in which a specialized, in particular conical, shape of the yarn drum in the vicinity of where the yarn is wound on assures that the storage winding will be continuously advanced axially as it forms, the danger exists that if the yarn run-off is interrupted, the storage winding will be "overrun"; that is, the newly formed windings of the arriving yarn will shift upward past the upper rim of the yarn drum. Yarn drums of this kind are described in German Patent De-PS No. 27 43 749, German examined application DE-AS No. 17 60 738 and German Patent DE-PS No. 33 26 099, to name only a few examples.

The above danger that windings of the storage winding may emerge at the top beyond the rim of the yarn drum also exists whenever a knitting machine equipped with this type of yarn supply apparatuses is blown out with a jet of compressed air during operation, in order to clean out fluff. If the compressed air jet is handled carelessly, it may shift the arriving yarn out beyond the upper rim of the yarn drum because the yarn supply eye is so far from the yarn drum. The result is that the yarn becomes wound up above the yarn drum.

That eventuality, however, must absolutely be avoided.

Another important factor in proper functioning of yarn supply apparatuses of the above type is how the yarn runs off the yarn drum. If there is some disruption in the evenness of yarn run-off, for instance because torn-off filaments of the yarn are wound back onto the drum from below, or because loops or sags form in highly twisted yarn as it runs off, causing uneven yarn run-off or even causing the loops to be wound back on again, then this affects the removal of yarn from the storage winding and hence also affects the arrival of the yarn being supplied. Consequently the storage winding may no longer be capable of advancing properly, especially in the case of yarn drums where the axial advancement of the storage winding is effected over a conical surface where the yarn arrives, or the like, causing the newly formed windings to build up in the area of the surface where the yarn arrives and finally causing the yarn to be wound up above the yarn drum, as feared.

THE INVENTION

It is an object of the invention to devise a yarn supply apparatus which always assures satisfactory supply, even if the yarn drum that is used effects the advancement of the storage winding solely by means of the specialized form of its circumferential surface, which is distinguished by the multiplicity of its possible applications; and which makes it possible even to supply yarns that are difficult to work with without requiring major conversions.

Briefly, the yarn supply guide element is in the form of a bowed element having an elongated yarn opening disposed with its lengthwise extension transverse to the direction of yarn travel; the bowed element is located with its edge nearer the yarn drum below the upper rim of the yarn drum.

The yarn supply guide element, with its elongated yarn opening, functions like a lateral limitation bow. The yarn arriving from the yarn brake can travel onto the yarn roller laterally either to the right or to the left in the elongated yarn opening, depending on the direction of rotation of the yarn drum; the lateral edges of the yarn opening prevent the yarn from shifting uncontrollably.

In a preferred embodiment, the yarn opening is located substantially in a plane that is inclined with respect to the axis of rotation of the yarn drum, for instance forming an angle on the order of magnitude of 80°–90° with the axis of rotation. Thus the supplied yarn arriving from the yarn brake can be held in contact with the front edge of the yarn opening, i.e., the edge remote from the yarn drum, by the supply feeler acting on the yarn, so that the yarn is capable of traveling to the drum under relatively low tension.

On the side remote from the yarn drum, the yarn opening may be limited by a substantially straight front edge; in a modified embodiment, corresponding approximately to a circumferential surface of the yarn drum, this edge may be curved.

The rear edge of the yarn opening, next to the yarn drum, is advantageously located so that it extends in the immediate vicinity of the yarn drum. This edge has the function of preventing the yarn from shifting upward and out past the upper rim of the yarn drum. On the side nearer the yarn drum, the yarn opening may have two corners, in which the arriving yarn can be held, on both sides of the center line that passes through the axis of rotation of the yarn drum. These corners, which form the outermost ends of the yarn opening, are positioned close to the yarn roller, thereby substantially increasing the certainty that if yarn is not being run off the storage drum or if there is an error when the yarn supply apparatus is being blown out with compressed air, no yarn windings will get outside beyond the upper rim of the yarn drum and be wound up there. At the same time, the yarn can vary its direction of travel to the yarn drum only insignificantly as the supply feeler drops, which is important for proper buildup of the storage windings.

For the above reasons, it is suitable for the rear edge of the yarn opening, which partly forms the two corners of the yarn opening and extends between the two corners on the side nearer the yarn drum, to take a course that is at least approximately matched to the circumference of the yarn drum. Manufacturing is simplified if the rear edge is formed by two substantially straight edge pieces, which form an obtuse angle with one another.

The lateral edges of the yarn opening that partly form the two corners may be embodied such they they diverge toward the yarn drum. Furthermore, the bow including the yarn opening may have a yarn introduction opening leading into the yarn opening, to facilitate threading the yarn.

The danger of a distruption in the run-off situation and thus of "overrun" of the storage winding with windings that extend out past the upper rim of the yarn drum can be reduced by providing that the run-off sensor is supported at two spaced-apart points on the unwinding yarn, one of which is located before and the other after the fixed run-off guide element, as viewed in the yarn travel direction.

To this end, the run-off sensor may have two spaced-apart support elements, in the form of ribs. If the tension of the unwinding yarn varies, the two ribs of the run-off sensor together with the fixed run-off guide element form desired yarn loops. If there is a disruption arising in the machine, these yarn loops make precise operation of the yarn supply apparatus substantially less susceptible to distruption, because the disruptions are not transmitted directly to the yarn drum and hence to the storage winding. The front rib in the direction of yarn travel has the further function of keeping the yarn that is running loosely off the yarn drum near the yarn drum and far below its lower rim, if there is a disruption, so as to assure satisfactory rewinding.

In highly twisted yarns, which have a marked tendency to form loops as they run off the yarn drum if there is no tension on them, the ribs in combination with the fixed run-off guide element cause a re-tightening of these loops, before the yarn travels to the work station at the machine.

A fixed yarn guide element is advantageously provided after the rear support position of the run-off sensor, in the direction of yarn travel, which assures that the yarn arriving from the yarn supply apparatus is directed toward the work station of the machine along a precisely defined path.

The run-off element is advantageously in the form of a bow having a yarn opening that is large in comparison with the yarn thickness, and the edge of the yarn opening is spaced apart on all sides of the yarn when it is running off under normal tension. Only if the run-off sensor drops downward in response to decreasing yarn tension does the lower edge of the yarn opening come into play, to form loops as mentioned above. To this end, the yarn opening may have a substantially straight lower edge extending transversely to the yarn; this assures a certain lateral mobility of the yarn traveling over it, which is significant for instance for tightening up loops.

Finally, a yarn eye can also be provided on the bow that forms the run-off element, below the yarn opening; this yarn eye is located farther beneath the lower rim of the yarn drum than is the yarn opening. The yarn eye is used for guiding the yarn running off the yarn drum only if synthetic endless yarns of poor quality are being processed, in particular yarns with torn or damaged filaments. The low placement of the yarn eye means that the yarn has a steeper run-off angle than what would be provided by the yarn opening located above it. This steeper run-off angle presents torn-off filaments from separating from the yarn itself and then becoming wound up as a separate winding on the yarn drum, which disrupts yarn run-off. The yarn drum thereby remains free of accumulations of filaments.

To facilitate operating a multifeed circular knitting machine equipped with the novel yarn supply apparatuses, the arrangement may be such that a respective switch associated with the supply sensor and the run-off sensor and located in its own "stop-motion" circuit is controlled by the supply and run-off sensors, and that at least the stop-motion circuit of the run-off sensor includes a selectively actuatable additional switch, which is optionally embodied as a transfer switch. Because each of the sensors acts separately on its own stop-motion circuit, it is extremely simply to stop the run-off sensor, for instance, and keep only the supply sensor running, as is desirable for instance when performing adjustments in multi-feed knitting machines.

Figure 2:
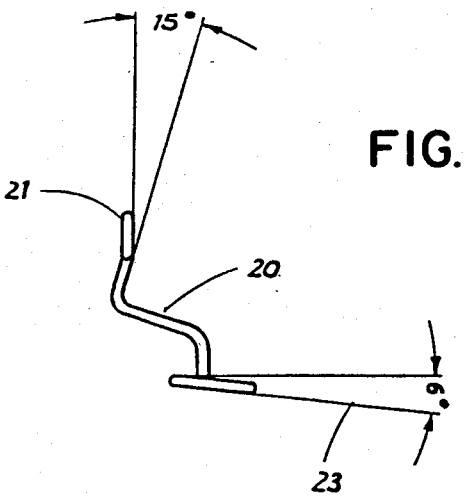
Figure 3:
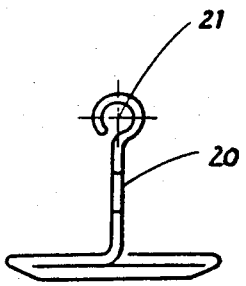
Figure 4:
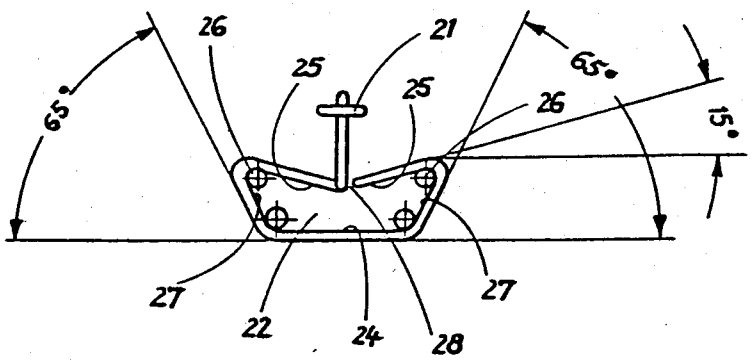

An exemplary embodiment of the subject of the invention is shown in the drawing. Shown are:

FIG. 1, a side view of a yarn supply apparatus according to the invention;

FIGS. 2 and 3, two different side views of the yarn supply guide element of the yarn supply apparatus of FIG. 1;

FIG. 4, a plan view of the yarn supply guide element of FIG. 2;

FIG. 5, a plan view of the run-off sensor of the yarn supply apparatus of FIG. 1;

FIG. 6, a side view of the run-off sensor of FIG. 5;

FIG. 7, a detail view of the run-off sensor of FIG. 6, looking downwardly on FIG. 6;

FIG. 8, another plan view of the run-off sensor of FIG. 5,

FIG. 9, a plan view of the run-off guide element of the yarn supply apparatus of FIG. 1;

FIGS. 10 and 11, two different side views of the run-off guide element of FIG. 9; and FIG. 12, the electrical stop-motion circuit associated with the supply sensor and the run-off sensor of the yarn supply apparatus of FIG. 1.

The yarn supply apparatus shown in FIG. 1 has a holder 1, which can be mounted by means of a securing device 2 upon an appropriate retaining ring, for instance of a circular knitting machine. A continuous shaft 3 is rotatably supported in the holder 1; at one end, the shaft 3 has a belt pulley 4, joined to it in a rotationally fixed manner, and a coaxial yarn drum 5 is secured to the shaft at its other end, again in a rotationally fixed manner.

On its end opposite the securing device 2, the holder 1 has two fixed, spaced-apart yarn eyes 6, 7, through which the incoming yarn 8, arriving from a spool not otherwise shown, is guided via a yarn brake 9 located on the holder 1 onto the circumference of the yarn drum 5. On the yarn drum 5, the yarn 8 forms a storage winding 10, from which the yarn is drawn off, running off the yarn drum 5 at the same speed with which it was wound up thereon. The yarn being run off travels through a fixed yarn eye 11, located on the holder 1 and in the form of an open bow, to the work station, not otherwise shown, in the knitting machine equipped with the yarn supply apparatus.

The design of the yarn drum is described in detail in German Patent Disclosure Document DE-OS No. 33 26 099, to which U.S. Pat. No. 4,574,597, Buck & Roser, corresponds. The yarn drum 5, embodied as a solid generated by rotation, has a first conical circumferential surface 12 with a straight generatrix, the largest diameter of which is in the vicinity of the free face end 13 of the yarn drum, and which is separated from this free end by a short axial cylindrical surface 14. The first conical circumferential surface 12, which forms an arrival surface for the yarn, forms an angle of approximately 30° with the axis 15 of the yarn drum. In the vicinity of its smallest diameter, this surface 14 forms an annular surface 16, which extends substantially at right angles to the axis 15 of the yarn drum. Adjoining the annular surface 16 on the inside is a second conical circumferential surface 17 which tapers inward in the axial direction, and which forms an angle of approximately 60°–70°, preferably 68°, with the axis 15 of the yarn drum. Following the second conical circumferential surface 17 in the axial direction of the yarn drum 5 is a conical yarn support surface having a straight generatrix. In FIG. 1, this yarn support surface is located underneath the storage winding 10 and serves to receive a portion, encompassing a plurality of adjacent windings, of the storage winding 10; it forms an angle of between 2° and 10° with the yarn drum axis 15. It is adjoined by a cylindrical jacket surface 18, which has a relatively long axial length and serves to receive the actual storage winding 10; this surface ends at a radially protruding continuous rim 19 located on the end of the yarn drum 5; the cross-sectional shape of the rim 19 may also be rounded.

Because of the particular shaping of the yarn drum 5 in the yarn supply area as desribed above, the yarn 8 that arrives at a tangent upon the conical circumferential surfaces 12, 17 adds new windings continuously to the storage winding 10, and these new windings are automatically shifted downward in the axial direction onto the cylindrical jacket surface 18, from whence the yarn 8 is drawn off over the rim 19.

Directly beside the yarn drum 5, in the area between the yarn brake 9 and the yarn drum 5, there is a stationary yarn guide element secured to the holder 1 and embodied in the form of a wire bow 20, the shape of which is shown in its various details in FIGS. 2–4 in particular:

The bow 20, which at one end has a fastening eye 21, defines an oblong yarn opening 22, which is located with its lengthwise extension transverse to the direction of yarn travel, as may be seen in FIG. 1. The yarn opening 22 is located in a plane indicated at 23 in FIG. 2, which is inclined with respect to the rotary axis 15 of the yarn drum and forms with it an angle on the order of magnitude of 80°–90° (6° with respect to the horizontal). On its side remote from the yarn drum 5, the yarn opening 22 is defined by a substantially straight front edge 24, which extends at right angles to a line that extends from the yarn brake 9 to the rotary axis 15 of the yarn drum 5. Alternatively, the yarn opening 22 could also be defined on this side by a front edge 24 that is curved, approximately matching the circumferential surface of the yarn drum.

The rear edge of the yarn opening 22, that is, adjacent the yarn drum 5, is located extending in the immediate vicinity of the yarn drum. It is formed by two substantially straight edge pieces 25, which form an obtuse angle with one another that in the embodiment of FIG. 4 amounts to 150°. Here again, a continuous rear edge 25 curved to match the circumferential surface of the yarn drum 5 could alternatively be provided.

On both sides of the above-mentioned center lines extending from the yarn brake 9 and passing through the rotary axis 14 of the yarn drum 5, two corners 26 are formed in the yarn opening 22, which are defined on one side by the rear edge extending between them and on the other by two substantially straight lateral edges 27, which are arranged to diverge toward the yarn drum 5 and in the exemplary embodiment of FIG. 4 form an angle of 50° with one another. The distance between the corners 26 is approximately half as large as the diameter of the yarn drum 5 in the corresponding region. Finally, a yarn introduction opening leading laterally into the yarn opening 22 from the side is provided in the vicinity of the rear edge at 28; this facilitates threading the yarn 8 into the yarn opening 22.

In the region between the yarn brake 9 and the yarn opening 22, a spring-loaded supply sensor 30 is supported on the supplied yarn 8, being pivotably supported at 29 on the holder 1. Because of the oblique position of the yarn opening 22, the yarn 8 is held elastically on the front edge 24 of the yarn opening 22 and is supported, so that it can advance to the yarn drum 5 under relatively low tension. The yarn then travels through the right or left corner 26—depending on the direction of rotation of the yarn drum 5—of the yarn opening 22, in which it is automatically held, so that even if the supply yarn tension decreases, it can vary its direction with respect to the yarn drum 5 only insignificantly. This is important for proper formation of the windings. At the same time, the rear edge pieces 25 prevent the yarn from shifting upward and perhaps escaping beyond the upper rim of the yarn drum 5. The yarn is always directed exactly onto the conical arrival surfaces 12, 17 of the yarn drum 5 by this rear edge 25. At the same time, the yarn drum 5 is relatively extensively wound about, because the corners 26 are located in the immediate vicinity of the adjacent circumference of the yarn drum. As shown in FIG. 1, the rear edge 25 is located lower than the upper rim of the yarn drum 5; it is approximately at the level of the upper end of the first conical circumferential surface 12.

On the yarn run-off side of the yarn drum 5, a fixed run-off guide element is fixedly located on the holder 1 before the fixed yarn eye 11, as seen in the yarn travel direction; this run-off guide element is in the form of a bow 31. Like the supply guide element in the form of the bow 20, this run-off guide element 31 may also be located on the holder 1 such that its height is adjustable. Its exact structure can be found in FIGS. 9–11.

The bow 31, bent into approximately the shape of an L and firmly screwed to the holder 1 at 32, has a continuous, approximately rectangular yarn opening 33, which on its underside is defined by a straight, horizontal edge 34 and the dimensions of which are substantially greater than the thickness of the yarn. The yarn opening 33, as shown in FIG. 1, is oriented approximately parallel to the rotary axis 15 of the yarn drum 5, while a yarn eye 36, through which the yarn as it runs off can selectively be guided, is located on the end on the shank 35 of the bow 31 that is bent at an obtuse angle.

In the region before and after the bow 31, a spring-loaded run-off sensor bow 38 which is pivotably supported at 37 on the holder 1 is supported at two points on the yarn being drawn off, this support being effected via transverse ribs 39, 40. The exact form of the run-off sensor bow 38 is shown in FIGS. 5–8.

As long as the tension on the yarn leaving the yarn drum 5 does not fall below a predetermined threshold value, the situation shown in FIG. 1 prevails, in which the yarn does not touch the edge of the yarn opening 33 but instead is guided solely by the yarn eye 11.

If the yarn tension drops, then the run-off sensor bow 38 moves downward, and via the two transverse ribs 39, 40 in cooperation with the lower edge 34 of the yarn opening 33 of the run-off guide bow 31, the yarn is drawn out into loops. The yarn reserve that is thereby provided keeps disruptions from affecting the storage winding 10. Furthermore, the yarn that runs off loosely in the event of a disruption is in this way kept far below the lower edge of the yarn drum 5, which assures satisfactory rewinding. Highly twisted yarn having a marked tendency to form loops can be handled easily, because by means of the transverse ribs 39, 40 in cooperation with the edge of the yarn opening 33, these loops are straightened again by the time they leave the yarn eye 11.

The ceramic yarn eye 36 located at the lower end of the run-off guide bow 31 receives the yarn leaving the yarn roller 5 whenever torn or damaged filaments must be expected, for instance with an endless synthetic yarn of poor quality, which otherwise would tend to be wound up on the yarn drum 5.

The supply sensor 30 and the run-off sensor 38 have supply and run-off yarn monitors associated with them and located in the holder 1 that is embodied like a housing. The supply sensor 30 controls a switch 41 (FIG. 12), while the run-off sensor 38 can actuate a switch 42. The two switches 41, 42 are located in two separate single-pole switching circuits, which are connected via contact pins 43 of the holder 1 with an external circuit which passes on signals for shutting down the machine, and so forth. In the two separate stop-motion circuits associated with the supply sensor 30 and the run-off sensor 38, there are respective indicator lamps 44, each of which lights up in the event of a disruption, that is, if the switch 41 or 42 is closed. The stop-motion switching circuit associated with the run-off sensor includes, in addition to the switch 41, a manually actuated switch 45, which makes it possible for instance to shut off the run-off sensor 38 while the machine is being adjusted and to keep only the supply sensor 30 operating. The switch 45 is embodied as a transfer switch, and it cooperates with a second supply main. On switching over from the operating setting to the shut-off run-off sensor, the indicator lamp 44 may light up without causing the machine to be shut off.

I claim:

1. Yarn supply apparatus for textile machines having a yarn drum adapted to have an essentially vertical axis of rotation carrying a storage winding;

a yarn supply guide element supplying yarn to the yarn drum at a tangent;

a yarn run-off guide element guiding yarn drawn off in a downward direction located laterally beside the yarn drum, the run-off guide element being stationary and positioned spaced apart from and below a lower rim of the yarn drum;

a supply yarn monitor including a supply sensor for feeling incoming yarn located, in the direction of yarn travel, ahead of the supply guide element; and a run-off yarn monitor including a run-off sensor for feeling the yarn being removed, wherein the yarn supply guide element comprises a bowed element (20) formed with an elongated yarn travel opening (22) defining a lengthwise extension, which yarn opening (22) is located with its lengthwise extension transverse to the direction of travel of the yarn to the drum, said bowed element having a rear edge (25) oriented toward the yarn drum (5), which edge is located below an upper rim of the yarn drum (5).

2. Yarn supply apparatus according to claim 1, wherein the yarn opening (22) is located substantially in a plane (23) that is inclined with respect to a rotary axis (15) of the yarn drum (5).

3. Yarn supply apparatus according to claim 2, wherein said plane (23) forms an angle in the order of magnitude of 80°–90° with respect to said rotary axis (15).

4. Yarn supply apparatus according to claim 1, wherein the yarn opening (22) is defined on a side remote from the yarn drum (5) by a substantially straight front edge (24).

5. Yarn supply apparatus according to claim 1, characterized in that said rear edge (25) oriented toward the yarn drum (5) is located in the immediate vicinity of the yarn drum (5).

6. Yarn supply apparatus according to claim 1, characterized in that the yarn opening defines two corners (26) on the side oriented toward the yarn drum (5), and located on both sides of the center line passing through the rotary axis (15) of the yarn drum (5).

7. Yarn supply apparatus according to claim 6, characterized in that the rear edge (25) of the yarn opening (22) between the two corners (26) extends on the side adjacent the yarn drum (5) between the two corners (26), and is shaped to at least approximately match the circumference of the yarn drum (5).

8. Yarn supply apparatus according to claim 7, characterized in that the rear edge is formed by two substantially straight edge pieces (25), which form an obtuse angle with one another.

9. Yarn supply apparatus according to claim 6, characterized in that the yarn opening (22) is defined in part by two lateral edges (27) which terminate in said two corners (26), said edges diverging in a direction toward the yarn drum (5).

10. Yarn supply apparatus according to claim 1, characterized in that the bowed element (20) has a yarn introduction opening (28) leading laterally into the yarn opening (22).

11. Yarn supply apparatus according to claim 1, characterized in that the bowed element has a front edge (24) remote from the yarn drum; and the supply sensor (30) is positioned to hold incoming yarn in contact with the front edge (24).

12. Yarn supply apparatus according to claim 1, characterized in that the run-off sensor (38) includes two spaced-apart yarn support sections (39, 40), respectively located, as viewed in the yarn travel direction, after the stationary run-off guide element (31).

13. Yarn supply apparatus according to claim 12, characterized in that the two spaced-apart support sections include support ribs (39, 40).

14. Yarn supply apparatus according to claim 12, characterized in that a fixed yarn guide element (11) is provided located in yarn travel direction downwstream of the rear support section.

15. Yarn supply apparatus according to claim 14, characterized in that the run-off element comprises a bowed element (31) having a yarn opening (33) which is large in comparison with the thickness of the yarn, the yarn opening (33) being defined by spaced-apart edges on all sides from the yarn traveling through it when the yarn is under normal tension.

16. Yarn supply apparatus according to claim 15, characterized in that the yarn opening (33) is defined by a substantially straight lower edge (34) extending transversely with respect to the yarn.

17. Yarn supply apparatus according to claim 15, characterized in that a yarn eye (36) is provided, located on the bowed element (31) below the yarn travel opening (33), the yarn eye (36) being located farther below the lower rim of the yarn drum (5) than the yarn travel opening (33).

18. Yarn supply apparatus according to claim 1, characterized in that a respective switch (41, 42) is provided, associated with the supply sensor (30) and the run-off sensor (38) respectively, and located in a respective stop-motion circuit controlled by the respective sensors; and that at least the stop-motion circuit associated with the run-off sensor includes an additional, selectively actuable switch (45).

* * * * *